US006533545B1

(12) United States Patent
Hirano et al.

(10) Patent No.: US 6,533,545 B1
(45) Date of Patent: Mar. 18, 2003

(54) MOVING TURBINE BLADE

(75) Inventors: Yuichiro Hirano, Nagasaki (JP); Atsushi Matsuo, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/708,664

(22) Filed: Nov. 9, 2000

(30) Foreign Application Priority Data

Jan. 12, 2000 (JP) ..... 2000-003260

(51) Int. Cl.[7] ..... F01D 5/14
(52) U.S. Cl. ..... 415/191; 416/223 R; 416/DIG. 2
(58) Field of Search ..... 415/191, 208.2; 416/223 R, 223 A, DIG. 2, DIG. 5

(56) References Cited

U.S. PATENT DOCUMENTS

| | | | | | |
|---|---|---|---|---|---|
| 2,258,793 | A | * | 10/1941 | New | 415/194 |
| 2,258,795 | A | * | 10/1941 | New | 415/194 |
| 3,475,108 | A | * | 10/1969 | Zickuhr | 415/194 |
| 3,776,363 | A | * | 12/1973 | Kuethe | 181/213 |
| 3,953,148 | A | * | 4/1976 | Seippel et al. | 415/199 R |
| 4,131,387 | A | * | 12/1978 | Kazin et al. | 415/119 |
| 4,431,376 | A | * | 2/1984 | Lubenstein et al. | 416/223 A |
| 4,626,174 | A | | 12/1986 | Sato et al. | |
| 4,695,228 | A | * | 9/1987 | Purcaru | 416/223 A |
| 4,968,216 | A | * | 11/1990 | Anderson et al. | 415/199.5 |
| 5,277,549 | A | * | 1/1994 | Chen et al. | 416/223 A |
| 5,342,170 | A | * | 8/1994 | Elvekjaer et al. | 415/192 |
| 5,586,053 | A | | 12/1996 | Park | |
| 6,036,438 | A | * | 3/2000 | Imai | 415/192 |

FOREIGN PATENT DOCUMENTS

| | | |
|---|---|---|
| FR | 2491546 | 4/1982 |
| GB | 293009 | 7/1928 |
| GB | 716811 | 10/1954 |
| GB | 1067169 | 5/1967 |
| WO | 95/29331 A2 | 11/1995 |

OTHER PUBLICATIONS

Copy of Spanish Search Report.

* cited by examiner

*Primary Examiner*—Edward K. Look
*Assistant Examiner*—Richard A. Edgar
(74) *Attorney, Agent, or Firm*—Birch, Stewart, Kolasch & Birch, LLP

(57) ABSTRACT

A moving turbine blade is disclosed. When an angle, which a tangent to a dorsal surface portion at a front edge of the moving turbine blade makes with a straight line perpendicular to a rotating shaft of a turbine, is designated as θ, and a geometrical outlet angle of a stationary blade is designated as $\alpha_n$, θ is in the relationship $\alpha_N+2°<\theta<\alpha_N+12°$. As a result, the shape of the dorsal surface portion, at the front edge and in a portion adjacent thereto, of the moving turbine blade is not parallel to a stationary blade wake. Thus, the moving turbine blade can contribute to increasing the efficiency of the turbine, while suppressing an unsteady sharp increase in flow velocity.

5 Claims, 5 Drawing Sheets

MOVING TURBINE BLADE

BACKGROUND OF THE INVENTION

1. Field of the Invention

This invention relates to a moving turbine blade, and more particularly, one useful when applied to an axial flow impulse turbine.

2. Description of the Related Art

FIG. 5 is a schematic view showing moving turbine blades, along with stationary turbine blades, of an axial flow impulse turbine according to an earlier technology. As shown in the drawing, a multiplicity of moving turbine blades 1 are disposed in a circumferential direction of an impeller (not shown). A multiplicity of stationary blades 2 are fixed to a casing (not shown) of the axial flow impulse turbine. The stationary blades 2 function as nozzles for supplying a high velocity, high pressure fluid (e.g. steam) to the moving turbine blades 1.

An analysis of flow velocity in this type of axial flow impulse turbine has now shown the occurrence of an important phenomenon. With this type of turbine, conventional knowledge has been that a slow flow velocity region extending in a band form, called a stationary blade wake 3 (a dotted portion in the drawing), is formed behind a rear edge 2*a* of the stationary blade 2. A recent finding is that each time the moving turbine blade 1 cuts across the stationary blade wake 3 upon rotation of the turbine, a high velocity region (a cross-hatching in the drawing) 4 of a sharply quickening fluid occurs on a dorsal surface portion 1*a* of the moving turbine blade 1. The mechanism for formation of this region may be as follows: The stationary blade wake 3 functions as an effective wall against a main stream with a high flow velocity. Consequently, as the moving turbine blade 1 approaches the stationary blade wake 3 in accordance with rotational movement of the moving turbine blade 1 (the direction of the rotational movement is indicated by an arrow A in the drawing), a throat of a passageway-effectively forms between the stationary blade wake 3 and the moving turbine blade 1. As a result, the high velocity region 4 of a sharply quickening fluid occurs on the dorsal surface portion 1*a*of the moving turbine blade 1 with the passage of time. Such a stationary blade wake 3 is formed behind each of the stationary blades 2, and the high velocity region 4 is also formed in correspondence with each stationary blade wake 3. However, only one stationary blade wake 3 and only one high velocity region 4 are shown in the drawing as representatives.

When the above-described unsteady high velocity region 4, where the flow velocity sharply increases at the instant of approach to the stationary blade wake 3, is formed on the dorsal surface portion 1*a* of the moving turbine blade 1, a turbine loss at this site is great. This is because if the wall stands in the passageway of the fluid, friction corresponding to the difference in flow velocity between the high velocity region and the low velocity region appears, and the kinetic energy of the fluid changes into heat owing to this friction. That is, a total pressure loss occurs. Thus, the efficiency of the turbine declines.

SUMMARY OF THE INVENTION

The present invention has been accomplished in light of the foregoing problems with the earlier technology. The object of the invention is to provide a moving turbine blade which can contribute to increasing the efficiency of a turbine while suppressing an unsteady, sharp increase in flow velocity.

To attain the above object, the inventors investigated conditions for formation of a marked high velocity region 41 and obtained the following findings: The shape of the stationary blade wake 3 is determined simply by the shape of the stationary blade 2. The moving turbine blade 1, on the other hand, is configured from the aspect that a smooth flow velocity distribution in a range from a front edge 1*b* to a rear edge 1*d* of the moving turbine blade 1 is ensured based on the outlet angle of the fluid flowing out of the stationary blade 2. From this aspect, the approximate inlet angle and the approximate shapes of the dorsal surface portion 1*a* and a ventral surface portion 1*c* are determined. As a result, with the moving turbine blade 1 according to the earlier technology, the dorsal surface portion 1*a* at the site of the front edge 1*b* of the moving turbine blade 1 is shaped to be parallel to the stationary blade wake 3. This shaping of the dorsal surface portion 1*a* of the moving turbine blade 1 to be parallel to the stationary blade wake 3 may be the major cause of the unsteady, sharp increase in the flow velocity. When the dorsal surface portion 1*a* is shaped to be parallel to the stationary blade wake 3, a throat of the passageway is formed, most prominently, between the stationary blade wake 3 and the dorsal surface portion 1*a* of the moving turbine blade 1.

The features of the present invention based on the foregoing findings are characterized by the following aspects 1) to 5):

1) A moving turbine blade in a turbine having a multiplicity of moving turbine blades disposed in a circumferential direction of an impeller, the moving turbine blades being acted on by a fluid, which has left stationary blades as fixed blades, to transmit a rotating force to the impeller, wherein:

a shape of a dorsal surface portion, at a front edge and in a portion adjacent thereto, of the moving turbine blade is a chamfered shape so as not to be parallel to a stationary blade wake.

According to the above aspect of the invention, the shape of the dorsal surface portion at the front edge of the moving turbine blade can be displaced from the stationary blade wake. Thus, it becomes possible to widen a passageway formed between the dorsal surface portion at the front edge of the moving turbine blade and the stationary blade wake when the moving turbine blade cuts across the stationary blade wake upon its rotational movement. Hence, an unsteady increase of the flow velocity on the dorsal surface portion can be suppressed. Consequently, even when the moving turbine blade periodically cuts across the stationary blade wake in accordance with movement of the moving turbine blade, it becomes possible to remove a partial high velocity region of the flow velocity, eliminate a total pressure loss at this site, and contribute to increasing the efficiency of the turbine.

2) In the moving turbine blade described in the aspect 1) above, when an angle, which a tangent to the dorsal surface portion at the front edge of the moving turbine blade makes with a straight line perpendicular to a rotating shaft of the turbine, is designated as $\theta$, and a geometrical outlet angle of the stationary blade is designated as $\alpha_N$, $\theta$ is in the following relationship:

$$\alpha_N+2^\circ<\theta<\alpha_N+12^\circ$$

According to this aspect, not only the actions described in the aspect 1) have been obtained, but also the upper limit value of $\theta$ has been restricted. Thus, a geometrical relationship, such as the inlet angle of the moving turbine blade relative to the outlet angle of the stationary blade, can be ensured optimally. Consequently, the moving turbine blades can contribute to increasing the efficiency of the turbine, without sacrificing other characteristics.

3) In the moving turbine blade described in the aspect 1) or 2) above, when a maximum blade thickness of the moving turbine blade is designated as $T_{max}$, and a blade width, which is a distance between the front edge and a rear edge of the moving turbine blade, is designated as W, $T_{max}/W$ is in the following relationship:

$$0.33<T_{max}/W<0.42$$

According to this aspect, not only the actions described in the aspects 1) and 2) have been obtained, but also the blade shape of the moving turbine blade is thin-walled. Thus, the passageway between the adjacent moving turbine blades is widened. The average flow velocity at this site can be decreased. Consequently, a high velocity region of the flow velocity between the stationary blade wake and the dorsal surface portion of the moving turbine blade can be removed further satisfactorily, and a further increase in the turbine efficiency can be facilitated.

4) In the moving turbine blade described in the aspect 1) or 2) above, when an angle, which a tangent to a ventral surface portion at the front edge of the moving turbine blade makes with a tangent to the dorsal surface portion, is designated as $\beta_{inc}$, $\beta_{inc}$ is in the following relationship:

$$13°<\beta_{inc}<27°$$

According to this aspect, not only the actions described in the aspects 1) and 2) have been obtained, but also the moving turbine blade has a small blade thickness in the vicinity of the front edge where the flow velocity is particularly increased because of the stationary blade wake. Thus, the passageway between the adjacent moving turbine blades is widened. The average flow velocity at this site can be decreased. Consequently, a high velocity region of the flow velocity between the stationary blade wake and the dorsal surface portion of the moving turbine blade can be removed further satisfactorily, and a further increase in the turbine efficiency can be facilitated.

5) In the moving turbine blade described in the aspect 1) or 2) above, when a maximum blade thickness of the moving turbine blade is designated as $T_{max}$, and a blade width, which is a distance between the front edge and a rear edge of the moving turbine blade, is designated as W, $T_{max}/W$ is in the following relationship:

$$0.33<T_{max}/W<0.42,$$

and when an angle, which a tangent to a ventral surface portion at the front edge of the moving turbine blade makes with a tangent to the dorsal surface portion, is designated as $\beta_{inc}$, $\beta_{inc}$ is in the following relationship:

$$13°<\beta_{inc}<27°$$

According to this aspect, the superimposition of the actions described in the aspect 1) or 2) and the aspects 3) and 4) is obtained. Consequently, the turbine efficiency can be increased most remarkably.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention will now be described with reference to the accompanying drawings, but it should be understood that the invention is not restricted thereby.

The embodiment is concerned with contrivances worked out for the shape of a dorsal surface portion of a moving turbine blade relative to a stationary blade wake. The problem is what angle of the moving blade should be set in response to the angle of the stationary blade wake. Thus, a geometrical outlet angle $\alpha_N$ has been defined as a parameter corresponding to the outlet angle of a stationary blade, and a preferred shape of the moving turbine blade has been specified in relation to this geometrical outlet angle $\alpha_N$. A stationary blade 2 is the same as that in the earlier technology shown in FIG. 5. The present embodiment will be explained as a moving turbine blade combined with such a stationary blade 2.

Figure 1A:
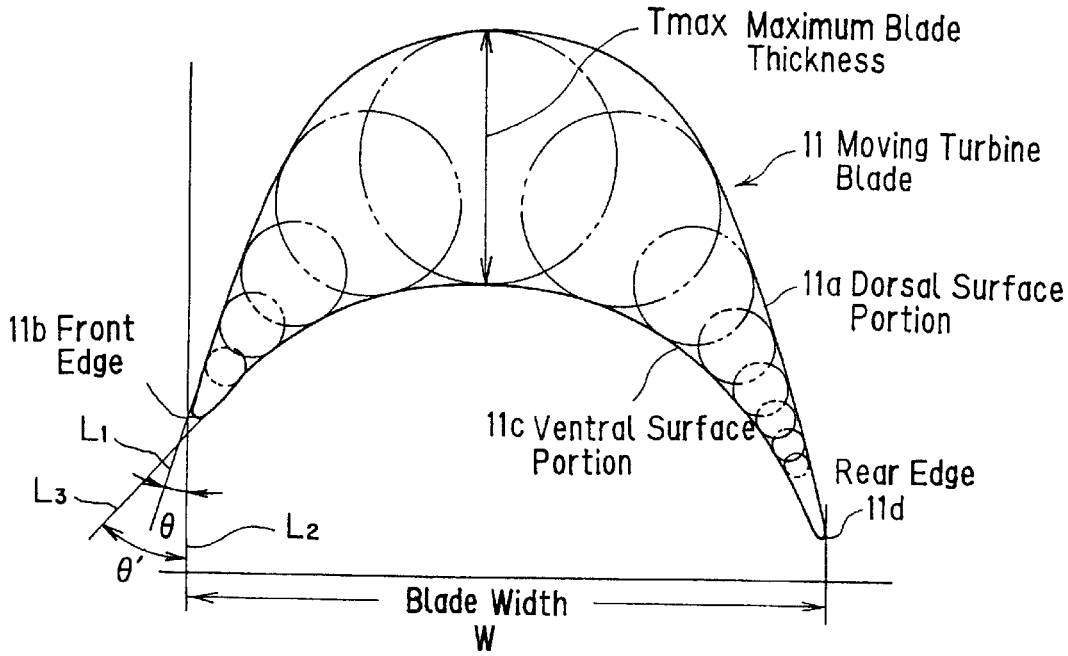
FIGS. 1(*a*) to 1(*c*) are views concerned with an embodiment of the present invention, in which FIG. 1(*a*) is a schematic view showing a moving turbine blade, FIG. 1(*b*) is an explanation view conceptually showing a geometrical outlet angle of a stationary blade, and FIG. 1(*c*) is a partial view showing, in an extracted manner, a front edge portion of the moving turbine blade.
Figure 1B:
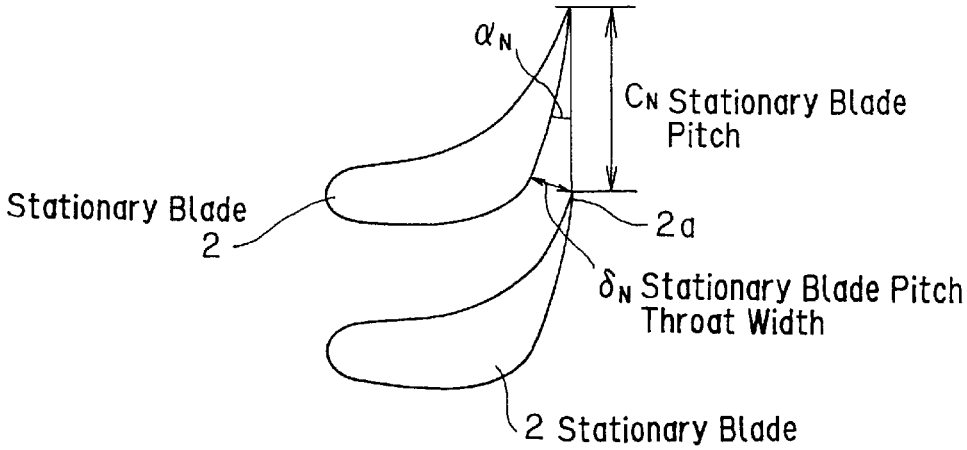
Figure 1C:
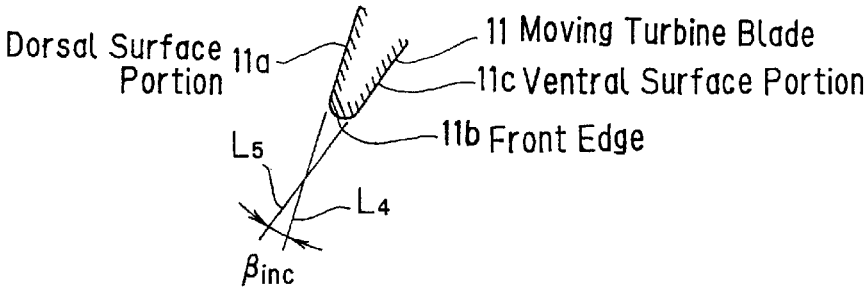

FIGS. 1(*a*) to 1(*c*) are views concerned with the embodiment of the present invention, in which FIG. 1(*a*) is a schematic view showing a moving turbine blade, FIG. 1(*b*) is an explanation view conceptually showing a geometrical outlet angle of a stationary blade, and FIG. 1(*c*) is a partial view showing, in an extracted manner, a front edge portion of the moving turbine blade.

Figure 5:
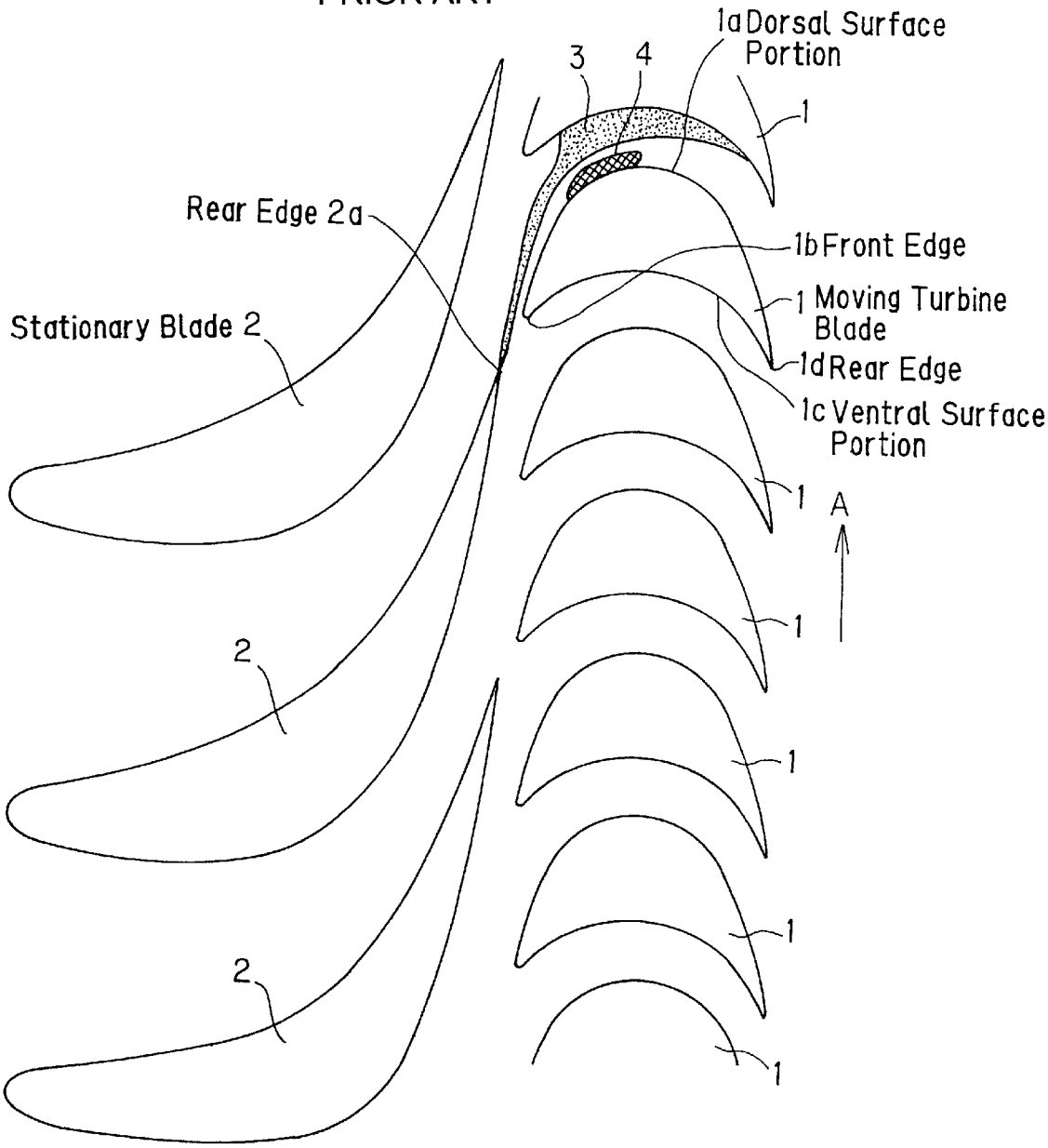
FIG. 5 PRIOR ART
FIG. 5 is a schematic view showing moving turbine blades, along with stationary blades, of an axial flow impulse turbine according to the earlier technology.

In FIG. 1(*a*), the reference numeral 11 denotes a moving turbine blade, 11*a* a dorsal surface portion, 11*b* a front edge, 11*c* a ventral surface portion, and 11*d* a rear edge. A multiplicity of such moving turbine blades 11 are disposed in a positional relationship as shown in FIG. 5, i.e., they are disposed in a circumferential direction of an impeller (not shown), and opposite stationary blades 2. Thus, a fluid coming out from among the stationary blades 2 is caused to act on the moving turbine blades 11, transmitting a rotating force to the impeller. When an angle, which a tangent $L_1$ to the dorsal surface portion 11*a* of the moving turbine blade 11 at the front edge 11*b* of the moving turbine blade 11 makes with a straight line $L_2$ perpendicular to the rotating shaft of the turbine, is designated as θ, and a geometrical outlet angle of the stationary blade 2 is designated as $\alpha_N$, θ is in the range defined by the following Expression (1):

$$\alpha_N+2^\circ<\theta<\alpha_N+12^\circ \quad (1)$$

More preferably, θ is in the range defined by the following Expression (2):

$$\alpha_N+5^\circ<\theta<\alpha_N+7^\circ \quad (2)$$

Here, the geometrical outlet angle $\alpha_N$ of the stationary blade 2 is an angle defined in the following manner: As shown in FIG. 1(*b*), a stationary blade pitch, which is the distance between the adjacent stationary blades 2, is designated as $C_N$, and a stationary blade throat width, which is the distance from a rear edge 2*a* of one of the adjacent stationary blades 2 to the dorsal surface portion of the other stationary blade 2, is designated as $\delta_N$. In this case, $\alpha_N$ is given by the equation $\alpha_N=\sin^{-1}(\delta_N/C_N)$, because the straight line that gives the stationary blade throat $\delta_N$, and a tangent to the stationary blade 2 which gives the geometrical outlet angle $\alpha_N$ can be handled as being approximately perpendicular to each other.

The upper limit of the angle θ set by the aforementioned numerical restriction is determined in consideration of the following factors: When the geometrical outlet angle $\alpha_N$of the stationary blade 2 is determined, the preferred shape of the portion at the front edge 11*b* of the moving turbine blade 11, corresponding thereto, is also determined. This preferred shape is given as having the sum of an angle θ' and the aforesaid angle θ, the angle θ' being an angle, which a tangent $L_3$ to the ventral surface portion 11*c* of the moving turbine blade 11 at the front edge 11*b* of the moving turbine blade 11 makes with a straight line $L_2$ perpendicular to the rotating shaft of the turbine. Thus, when the angle θ is fixed, the angle θ' is determined within the framework of the sum of the angle θ' and the angle θ. That is, the angle corresponding to this sum cannot be exceeded.

By restricting the angle θ as stated above, the shape of the dorsal surface portion 11*a* at the front edge 11*b* of the moving turbine blade 11 can be displaced from the stationary blade wake 3 (see FIG. 5; the same will hold in the descriptions to follow) In other words, the shape of the dorsal surface portion 11*a* and the stationary blade wake 3 are not parallel any more, so that it becomes possible to widen the passageway formed between the dorsal surface portion 11*a* at the front edge 11*b* of the moving turbine blade 11 and the stationary blade wake 3 when the moving turbine blade 11 cuts across the stationary blade wake 3 upon its rotational movement. Hence, an unsteady increase in the flow velocity on the dorsal surface can be suppressed.

Figure 2:
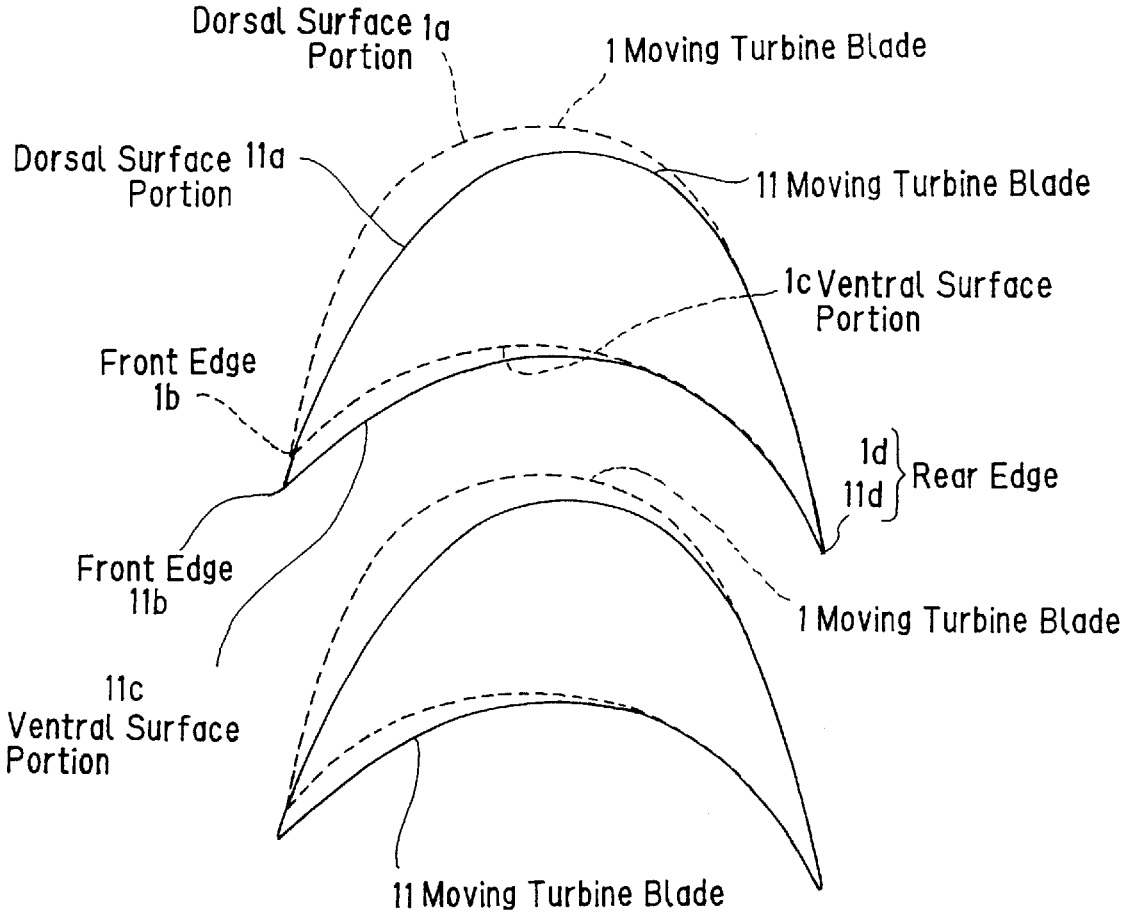
FIG. 2 is a schematic view showing the shapes (solid lines) of two moving turbine blades according to the embodiment of the present invention, in comparison with the shapes (dashed lines) of two moving turbine blades according to an earlier technology.

FIG. 2 is a schematic view showing the shapes (solid lines) of moving turbine blades 11 according to the above-described embodiment of the present invention, in comparison with the shapes (dashed lines) of moving turbine blade 1 according to the earlier technology shown in FIG. 5. As will become clear by reference to the drawing, the moving turbine blade 11 according to this embodiment takes a shape formed by chamfering the dorsal surface portion 1*a* close to the front edge 1*b* of the moving turbine blade 1 of the earlier technology (see FIG. 5; the same will hold in the descriptions to follow). As a result, the shape of the dorsal surface portion 11*a* can be displaced from the direction of the stationary blade wake. Incidentally, with the moving turbine blade 1 according to the earlier technology, the angle θ is formed to be nearly the same as the geometrical outlet angle $\alpha_N$ of the stationary blade 2. It is at least true that the angle θ does not exceed ($\alpha_N$+2°).

Because of the foregoing numerical restriction on the angle θ, the shape of the dorsal surface portion 11*a* of the moving turbine blade 11 can be displaced from, rather than parallel to, the stationary blade wake 3. In the present embodiment, the following additional numerical restriction is adopted:

Circles indicated by two-dot chain lines, which are inscribed in the shape of the moving turbine blade 11 shown in FIG. 1(*a*), have diameters representing the blade thicknesses of the moving turbine blade 11 at the site concerned. When the maximum blade thickness of the moving turbine blade 11 is designated as $T_{max}$, and the blade width, which is the distance between the front edge 11*b* and the rear edge 11*d* of the moving turbine blade 11, is designated as W, the ratio $T_{max}/W$ is constituted to fulfill the relationship $0.33<T_{max}/W<0.42$, preferably $0.34<T_{max}/W<0.38$. Because of this constitution, the blade shape of the moving turbine blade 11 is thin-walled. Thus, the passageway between the adjacent moving turbine blades 11 is widened, whereby the average flow velocity at this site can be decreased. Incidentally, the ratio $T_{max}/W$ in the moving turbine blade 1 according to the earlier technology exceeds 0.42.

In the present embodiment, the following further numerical restriction is performed: As shown in FIG. 1(*c*), an angle, which a tangent $L_4$ to the dorsal surface portion 11*a* at the front edge 11*b* of the moving turbine blade 11 makes with a tangent $L_5$ to the ventral surface portion 11*c*, is designated as $\beta_{inc}$, $\beta_{inc}$ is constituted to have the relationship $13^\circ<\beta_{inc}<27^\circ$. Because of this constitution, the moving turbine blade 11 has a small blade thickness in the vicinity of the front edge 11*b* where the flow velocity is particularly increased by the stationary blade wake 3. Thus, the passageway between the adjacent moving turbine blades 11 is widened, whereby the average flow velocity at this site can be decreased. Incidentally, the angle $\beta_{inc}$ in the moving turbine blade 1 according to the earlier technology exceeds 27°.

The lower limit values of the ratio $T_{max}/W$ and the angle $\beta_{inc}$ have been determined in order to obtain a predetermined blade thickness, because the blade thickness of the moving turbine blade 11 is restricted by the conditions for forming a smooth flow velocity distribution in the path from the front edge 11*b* to the rear edge 11*d* of the moving turbine blade 11.

In the turbine having the moving turbine blade 11 according to the present embodiment described above, the shape of the dorsal surface portion 11*a* of the moving turbine blade 11 is not parallel to the stationary blade wake 3. Thus, even when the moving turbine blade 11 cuts across the stationary blade wake 3 in accordance with rotational movement of the moving turbine blade 11, a relatively large passageway can be secured between the stationary blade wake 3 and the moving turbine blade 11. Hence, the high velocity region 4 (see FIG. 5) of a sharply increased flow velocity is not formed in this passageway area. Furthermore, the ratio $T_{max}/W$ and the angle $\beta_{inc}$ have been optimized to decrease the average flow velocity between the adjacent moving turbine blades 11. From this aspect as well, occurrence of the high velocity region 4 can be prevented.

Figure 3:
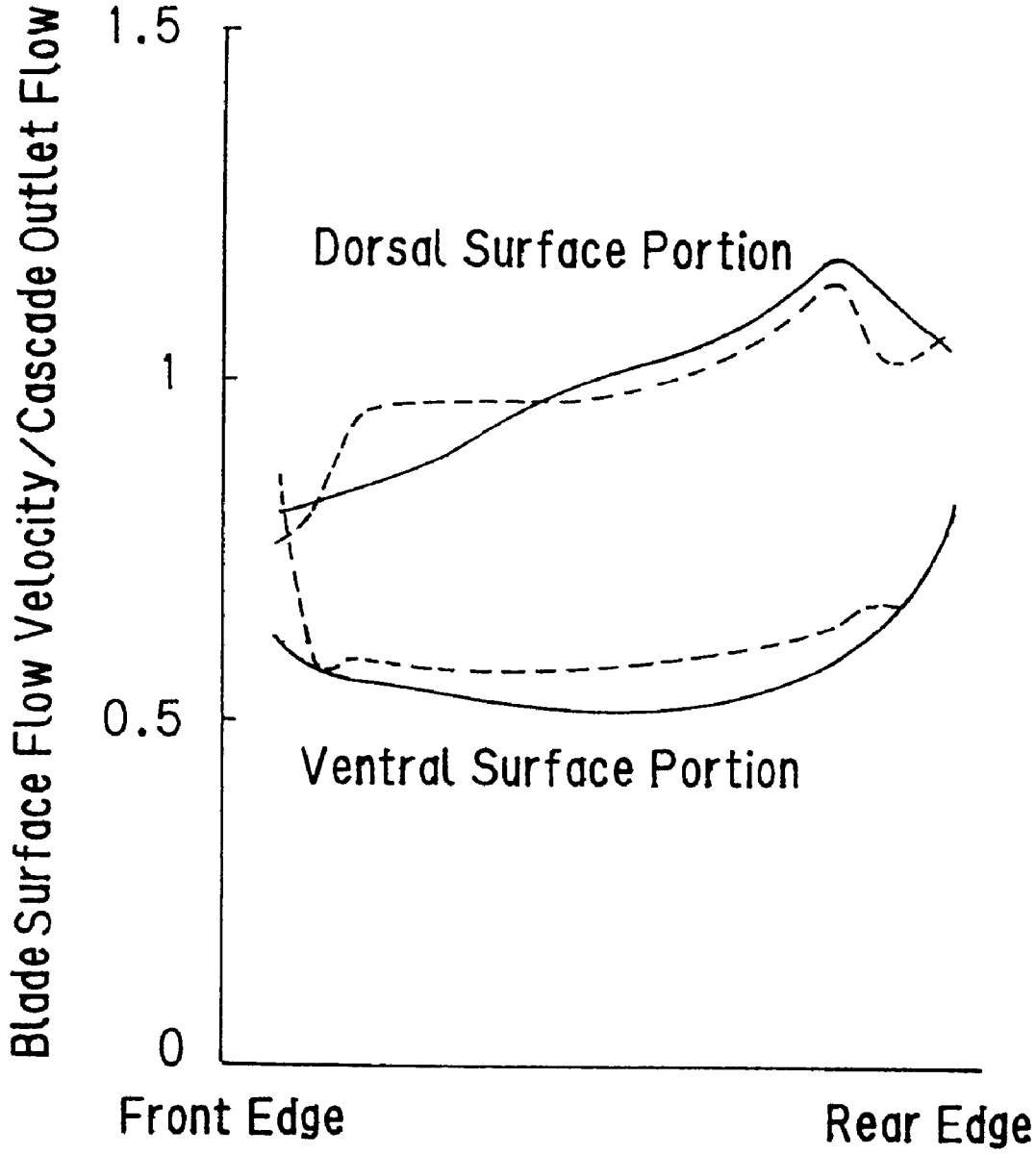
FIG. 3 is a characteristics view showing the blade surface flow velocity distribution characteristics (solid lines) of the moving turbine blade according to the embodiment of the present invention, in comparison with the blade surface flow velocity distribution characteristics (dashed lines) of the moving turbine blade according to the earlier technology.
Figure 4:
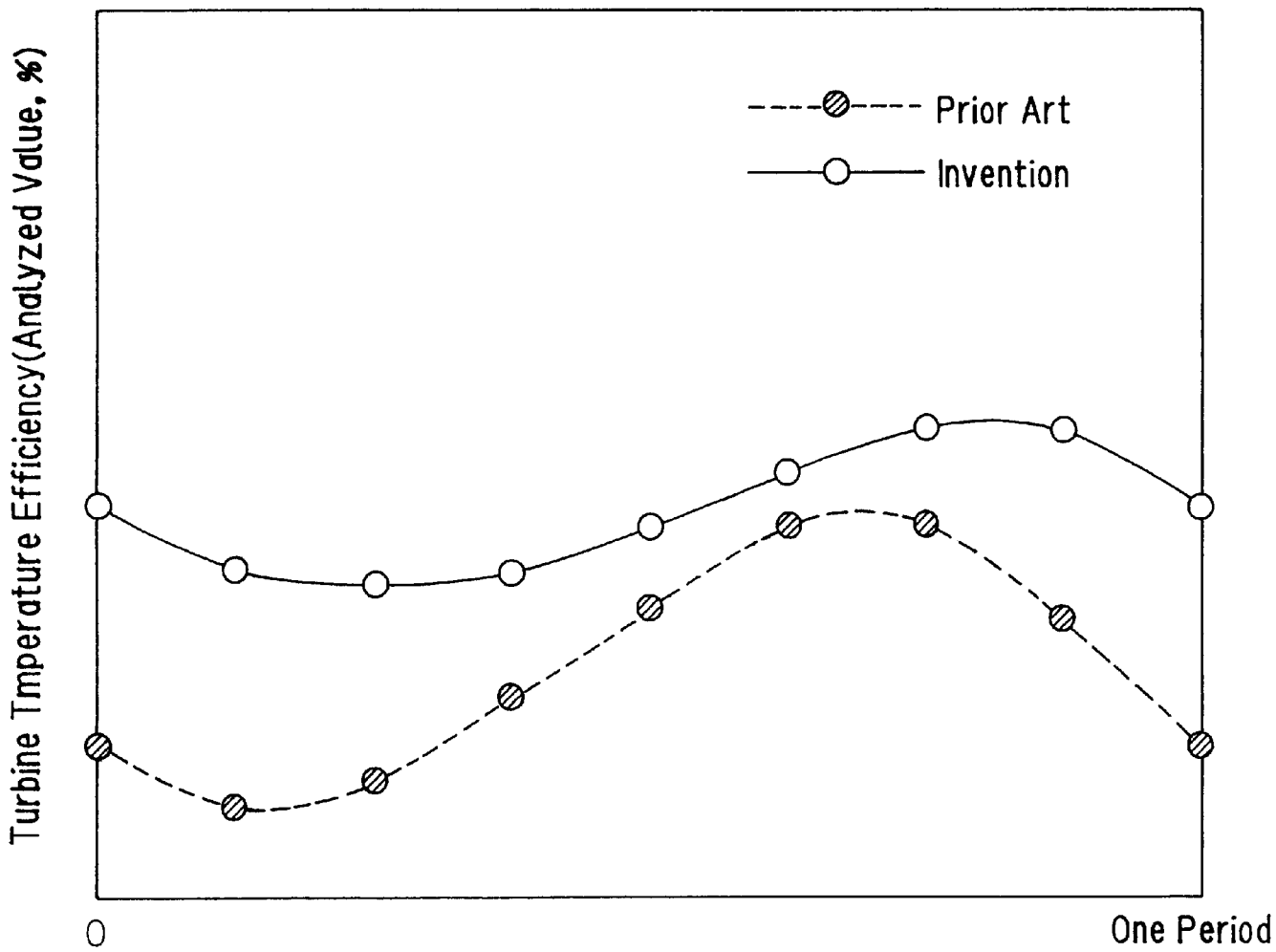
FIG. 4 is a characteristics view showing the turbine temperature efficiency (a solid line) of a turbine having the moving turbine blade according to the embodiment of the present invention, in comparison with the turbine temperature efficiency (a dashed line) of a turbine having the moving turbine blade according to the earlier technology.

FIG. 3 is a characteristics view showing the blade surface flow velocity distribution characteristics (solid lines) of the moving turbine blade 11 according to the above embodiment, in comparison with the blade surface flow velocity distribution characteristics (dashed lines) of the moving turbine blade according to the earlier technology. FIG. 4 is a characteristics view showing the turbine temperature efficiency (a solid line) of the turbine having the moving turbine blade 11 according to the above embodiment, in comparison with the turbine temperature efficiency (a dashed line) of a turbine having the moving turbine blade according to the earlier technology. By referring to FIG. 3, one will see that a marked decrease in flow velocity occurs on the dorsal surface portion 11*a* in the vicinity of the front edge 11*b* of the moving turbine blade 11. With reference to FIG. 4, the turbine efficiency is increased at any instant of one period, and the average efficiency in one period markedly increases, without doubt. One period in FIG. 4 refers to the time from the moment when one moving turbine blade 11 cuts across one stationary blade wake 3, until the moment when a next moving turbine blade 11 cuts across a next stationary blade wake 3. The specifications in FIGS. 3 and 4 are as follows: angle $\theta$=21.9°, ratio $T_{max}/W$= 0.38, and angle $\beta_{inc}$=24.3°.

The moving turbine blade 11 in the above-described embodiment has been explained as a moving turbine blade of an impulse turbine, but is not restricted thereto. However, the moving turbine blade will be particularly useful, if it is applied to an impulse turbine having a small inlet angle, and having a dorsal surface portion whose shape tends to be parallel to a stationary blade wake.

While the present invention has been described in the foregoing fashion, it is to be understood that the invention is not limited thereby, but may be varied in many other ways. Such variations are not to be regarded as a departure from the spirit and scope of the invention, and all such modifications as would be obvious to one skilled in the art are intended to be included within the scope of the appended claims.

What is claimed is:

1. A moving turbine blade in a turbine having a multiplicity of the moving turbine blades disposed in a circumferential direction of an impeller, the moving turbine blade being acted on by a fluid, which has left stationary blades as fixed blades, to transmit a rotating force to the impeller, wherein:

the moving turbine blade has a front edge shape comprised of a circle or an ellipse, and two curves of a dorsal surface and a ventral surface in contact with the circle or ellipse, the curve of the dorsal surface is defined such that the curve of the dorsal surface and a stationary blade wake are not parallel to each other adjacent a point of contact between the circle or ellipse of the front edge and the curve of the dorsal surface, wherein an angle which a tangent at the point of contact between the circular or elliptical shape of a front end portion of the front edge and the curve of the dorsal surface makes with a straight line perpendicular to a rotating shaft of the turbine, is designated as $\theta$, and a geometrical outlet angle of the stationary blade is designated as $\alpha_N$, where, $$\alpha_N=\sin^{-1}(\delta_N/C_N)$$

where $\delta_N$ is the stationary blade throat width which is the distance from a rear edge of a stationary blade to the dorsal surface of an adjacent stationary blade and $C_N$ is the stationary blade pitch and is the distance between adjacent stationary blades, and $\theta$ is related to $\alpha_N$ by the following relationship:

$$\alpha_N+2^\circ<\theta<\alpha_N+12^\circ.$$

2. The moving turbine blade of claim 1, wherein, when a maximum blade thickness of the moving turbine blade is designated as $T_{max}$, and a blade width, which is a distance between the front edge and a rear edge of the moving turbine blade, is designated as W, $T_{max}/W$ is in the following relationship:

$$0.33<T_{max}/W<0.42.$$

3. The moving turbine blade of claim 1, wherein:

when an angle, which a tangent to a ventral surface portion at the front edge of the moving turbine blade makes with a tangent to the dorsal surface portion, is designated as $\beta_{inc}$, $\beta_{inc}$ is in the following relationship:

$$13^\circ<\beta_{inc}<27^\circ.$$

4. The moving turbine blade of claim 1, wherein:

when a maximum blade thickness of the moving turbine blade is designated as $T_{max}$, and a blade width, which is a distance between the front edge and a rear edge of the moving turbine blade, is designated as W, $T_{max}/W$ is in the following relationship:

$$0.33<T_{max}/W<0.42$$

when an angle, which a tangent to a ventral surface portion at the front edge of the moving turbine blade makes with a tangent to the dorsal surface portion, is designated as $\beta_{inc}$, $\beta_{inc}$ is in the following relationship:

$$13^\circ<\beta_{inc}<27^\circ.$$

5. A turbine having a plurality of moving blades located on an impeller and receiving fluid from a plurality of fixed blades for imparting a rotary motion to the impeller, comprising:

a moving blade having a rounded front edge and respective curvilinear surface sections of a dorsal surface and a ventral surface extending away from the rounded front edge and where the curvilinear surface section of the dorsal surface adjacent the front edge is in non-parallel relationship with an adjacent portion of a blade wake leaving the rear edge of a stationary blade for suppressing the formation of a relatively high velocity region of fluid along the dorsal surface and eliminating a pressure loss thereat, and wherein a tangent line at a point of contact between the front edge and the curvilinear surface section of the dorsal surface of the blade and a straight line perpendicular to a rotating shaft form an angle $\theta$, wherein a geometrical outlet angle of the stationary blade is defined as $\alpha_N$, and wherein the efficiency of the turbine is increased where $$\alpha_N+2^\circ<\theta<\alpha_N+12^\circ.$$

* * * * *